US007221289B2

(12) United States Patent
Hom

(10) Patent No.: US 7,221,289 B2
(45) Date of Patent: May 22, 2007

(54) SYSTEM AND METHOD FOR OPERATING A LOOP DETECTOR

(75) Inventor: Wayne C. Hom, Cota de Caza, CA (US)

(73) Assignee: The Chamberlain Group, Inc., Elmhurst, IL (US)

( * ) Notice: Subject to any disclaimer, the term of this patent is extended or adjusted under 35 U.S.C. 154(b) by 124 days.

(21) Appl. No.: 10/976,609

(22) Filed: Oct. 29, 2004

(65) Prior Publication Data

US 2006/0092045 A1 May 4, 2006

(51) Int. Cl.
*G08G 1/01* (2006.01)

(52) U.S. Cl. ..... 340/933; 340/917; 340/919; 340/934; 340/939; 340/501

(58) Field of Classification Search ..... 340/933, 340/941, 910, 916, 917, 918, 932.2, 934, 340/935, 939, 919, 501, 870.17; 324/326, 324/328, 654, 655, 207.15, 207.17, 236
See application file for complete search history.

(56) References Cited

U.S. PATENT DOCUMENTS

| | | | | |
|---|---|---|---|---|
| 3,875,555 | A * | 4/1975 | Potter | 340/939 |
| 4,358,749 | A * | 11/1982 | Clark | 340/941 |
| 5,512,891 | A * | 4/1996 | Kang | 340/941 |
| 5,844,502 | A * | 12/1998 | Perez et al. | 340/941 |
| 5,936,551 | A | 8/1999 | Allen et al. | |
| 7,014,355 | B2 * | 3/2006 | Potter et al. | 368/90 |

* cited by examiner

*Primary Examiner*—Hung Nguyen
(74) *Attorney, Agent, or Firm*—Fitch, Even, Tabin & Flannery

(57) ABSTRACT

The temperature of an operator circuit is measured. A relationship between the temperature of the operator circuit and characteristics of the operator circuit is determined. The relationship is applied to the measured temperature of the operator circuit to create an adjustment action. The detection threshold is adjusted by the adjustment action.

18 Claims, 3 Drawing Sheets

SYSTEM AND METHOD FOR OPERATING A LOOP DETECTOR

FIELD OF THE INVENTION

The field of the invention generally relates to methods and devices for controlling loop detectors. More specifically, the invention relates to adjusting the characteristics of loop detectors over time.

BACKGROUND OF THE INVENTION

Loop detectors function by having a circuit detect the change in inductance of a wire loop when a vehicle enters the vicinity of the loop. For instance, in some previous systems, the loop inductance changes by approximately four percent when a vehicle enters the loop. This change of inductance may be detected by sampling the change of frequency of electrical signals used to oscillate the loop.

Loop detectors are frequently used at traffic lights to indicate that a vehicle is present at an intersection and to initiate the changing of the light so that the vehicle can proceed through the intersection. In another example, loop detectors are sometimes placed in front of a barrier, such as a gate or a garage door. When a vehicle enters the loop, the device indicates the detection of the vehicle to a moveable barrier operator system and an action may be taken. For instance, the door or gate may be opened or closed.

As mentioned, loop detectors may be used in conjunction with barrier movement operators. Barrier movement operators are automated systems which are used to move a barrier with respect to an opening. Examples of barriers to be moved include garage doors, gates, fire doors and rolling shutters. A number of barrier movement operators have been sold over the years most of which include a head unit containing a motor connected to a transmission. The transmission, which may include, for example, a belt drive, a chain drive, a screw drive, gear drive or extendible arm is then coupled to the barrier for opening and closing the barrier.

The physical and electrical characteristics of the loop detector circuit drift with temperature and other environmental conditions. Consequently, the detection threshold becomes unreliable and must be changed if accurate responses to loop inductances are to be made. Previous loop detector systems compensated for the component drift by using a running average filter in the loop detector. However, the running average filter approach has proven inadequate to compensate for long range changes in system operation. For instance, the running averages approach often causes the loop detector to ignore a vehicle when the vehicle was on the loop for a long period of time or when a number of vehicles traversed the loop sequentially. Consequently, the gate might never be opened to allow a waiting vehicle to pass through the gate. In other circumstances, the gate might close prematurely damaging one of the string of vehicles passing through the gate.

SUMMARY OF THE INVENTION

A system for compensating for thermal drift adjusts operating characteristics of a vehicle detector to take into account the drift. The approach ensures that the detection threshold does not become outdated and that the barrier operator functions properly.

In many of these embodiments, the temperature of components of an operator circuit affecting the frequency of operation of a loop detector is measured. The operator includes an oscillator and the oscillator has an associated detection threshold frequency. A change in the frequency of the oscillator is compared to a detection threshold frequency to determine when a vehicle is in the vicinity of the loop detector.

A relationship between the temperature of the components and adjustment actions or values (that are used to adjust characteristics of the loop detector circuit) may be stored in memory. In one example, adjustment actions are used to change characteristics of an oscillator in order to maintain the oscillator frequency at a fixed value. In another example, adjustment values are used to change the detection threshold frequency of the vehicle detector.

The measured temperature of the components is then applied to the relationship thereby identifying an adjustment value or action. The characteristics of the loop detector are altered by the adjustment value or action. Thereafter, with the characteristics altered, the change in frequency of the oscillator is compared to detection threshold frequency to determine if a vehicle is truly present at the loop.

In other of these embodiments, the temperature of components of a loop detector is measured. A relationship between the temperature and a detection threshold is determined. The relationship is applied to the measured temperature to create an adjustment value. The detection threshold is adjusted by the adjustment value. A weighted average related to the threshold may also be applied to the threshold. In this case, the detection threshold is adjusted using the weighted average and the adjustment value.

Thus, approaches are provided to maintain an updated detection threshold in a system using a loop detector to actuate a moveable barrier. The approaches described herein avoid the problems associated with previous systems such as missed detections of vehicles in the loop and premature barrier closings of vehicles entering through the barrier.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful in a commercially feasible embodiment are often not depicted in order to facilitate a less obstructed view of the various embodiments of the present invention.

DESCRIPTION OF THE PREFERRED EMBODIMENTS

Figure 1:
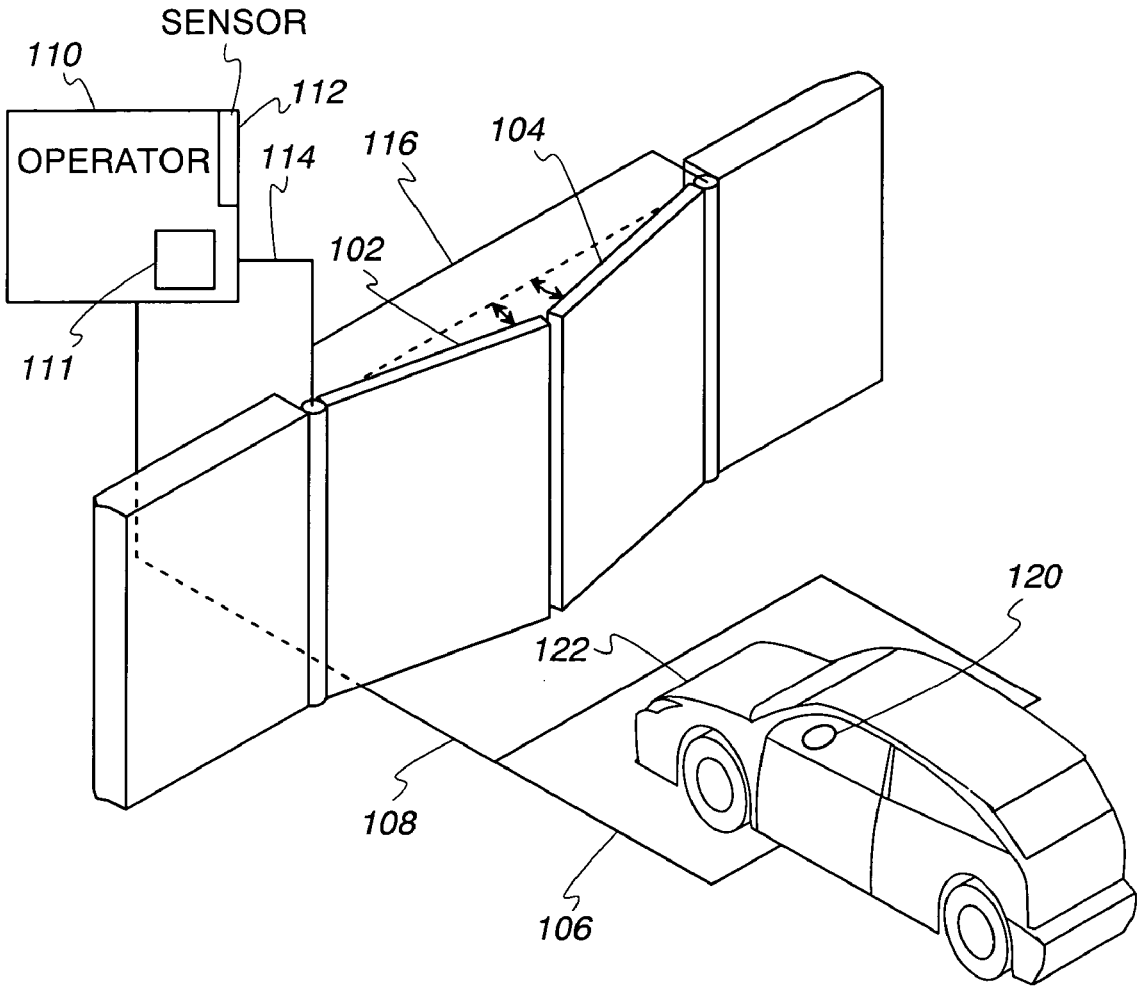
FIG. 1 is a block diagram of a system for compensating for temperature drift when detecting a vehicle according to the present invention.

Referring now to the drawings and especially FIG. 1, a system using a loop detector to open and close a moveable barrier is described. A wire loop 106 is placed in the ground in front of gates 102 and 104. The loop 106 is coupled to an operator 110 via a cable 108. The cable 108 provides a path for electrical signals representative of the inductance of the loop 106.

For illustrative purposes, the description with respect to FIG. 1 refers to moveable barriers that are gates. However, it will be understood by those skilled in the art that the moveable barrier may not only be a gate, but may be any type of barrier such as a fire door, shutter, window, garage door. Other examples of barriers are possible.

The operator 110 may provide circuitry for driving the loop detector 106 with an oscillator 111. For convenience in viewing, the operator 110 is shown placed above a wall. However, it will be understood that the operator 110 may be positioned in any convenient and/or secure place, for example, behind the wall, in a building, or in the ground. The oscillator 111 may drive the loop 106 with an electrical signal having a frequency. When a vehicle 122 enters the loop 106, the frequency of the loop 106 changes. This change in frequency may be compared to a threshold stored at the operator 110 to determine if the vehicle 122 is in the loop 106. Alternatively, the operator 110 may supply a signal having a center frequency. Deviations from the center frequency are measured and if the deviation exceeds a threshold, then the vehicle 122 is determined to have entered the loop 106. Other detection methods may also be used.

The operator 110 is coupled to the gates 102 and 104 via a wire 116. The operator 110 determines when to open or close the gates 102 and 104. In addition, the operator 110 may include additional functionality to receive signals from a transmitter 120. The transmitter 120 may be carried in the vehicle 122. The transmitter 120 may be activated by a user in the vehicle 122. When the user activates the transmitter 120 and it is determined that the vehicle has entered the loop 106, then the operator 110 may open the gates 102 and 104 allowing the vehicle 122 to enter. Conversely, the operator 110 may automatically close the gates 102 and 104 when it is determined that the vehicle 122 has passed through the loop 106 and it is safe to close the gates 102 and 104.

The operator 110 includes a temperature sensor 112. The sensor 112 determines the temperature of components that affect the frequency characteristics of the loop 106. For example, the temperature of the oscillator 111 driving the loop 106 may be sensed. In another example, the air temperature within the operator 110 may be determined. A single or multiple sensors may be used to read the temperature. Temperatures of other components may also be determined. In addition, other parameters that affect the frequency (or other operating) characteristics of the loop 106 may also be measured.

The operator 110 also includes a memory. The memory stores the threshold, and a relationship between the temperature detected and control parameters used to adjust the loop detection circuit. For instance, the memory may store a table that indicates the adjustments to be made to the detection threshold frequency for a plurality of different temperatures. In another example, the memory may store an equation, which can be solved for a threshold value when the sensed temperature is used as the value of a variable. In still another example, the table may store oscillator adjustment parameters for different temperatures that ensure that the oscillator is driven at a constant frequency, for example, 10 Khz. Other examples of relationships between temperature and control parameters are possible.

The correlation between the temperature and the adjustment actions and values may be made at the time of manufacture of the operator 110. For instance, tests can be performed to determine the adjustments for threshold for given temperature ranges and this can be programmed into memory at the time the operator 110 is manufactured.

In one example of the operation of the system of FIG. 1, the temperature of the operator 110 (including the components that affect the frequency of the loop 106) is measured. The temperature may be measured by any type of temperature sensing device placed within the housing of the operator 110.

A relationship between the temperature of the operator 110 and parameters used to adjust the loop detection circuit is stored in memory. The relationship is applied to the measured temperature of the operator 110 to create an adjustment value or action. The characteristics of the circuit, for instance, the detection threshold frequency or the oscillator characteristics, are adjusted according to the adjustment value or action found in the table.

If a threshold is adjusted, a weighted average related to the threshold may also be used. In this case, the detection threshold is adjusted using the weighted average and the adjustment value.

Figure 2:
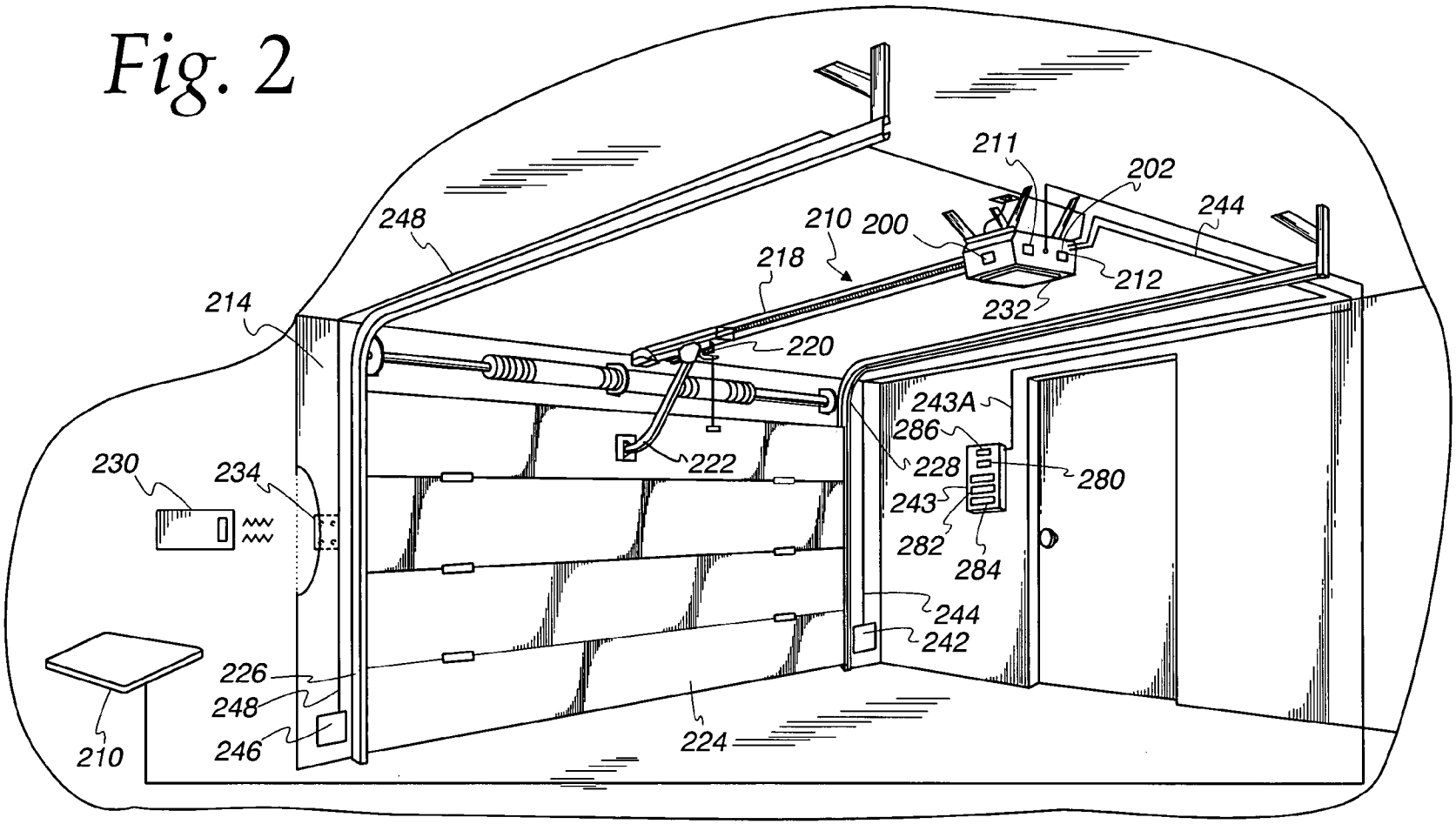
FIG. 2 is a block diagram of a system for compensating for temperature drift when detection a vehicle according to the present invention.

Referring now to FIG. 2, a movable barrier operator, which is a garage door operator, is generally shown therein and includes a head unit 212 mounted within a garage 214. The head unit 212 is mounted to the ceiling of the garage 214 and includes a rail 218 extending there from with a releasable trolley 220 attached having an arm 222 extending to a multiple paneled garage door 224 positioned for movement along a pair of door rails 226 and 228.

The description with respect to FIG. 2 refers to a moveable barrier that is a garage door. However, it will be understood by those skilled in the art that the moveable barrier may not only be a garage door but may be any type of barrier such as a fire door, shutter, window, or gate. Other examples of barriers are possible.

More specifically, the system includes a hand-held transmitter unit 230 adapted to send signals to an antenna 232 positioned on the head unit 212 as will appear hereinafter. An external control pad 234 is positioned on the outside of the garage having a plurality of buttons thereon and communicates via radio frequency transmission with the antenna 232 of the head unit 212. An optical emitter 242 is connected via a power and signal line 244 to the head unit. An optical detector 246 is connected via a wire 248 to the head unit 212. The head unit 212 also includes a receiver unit 202. The receiver unit 202 receives a wireless signal, which is used to actuate the garage door opener.

An oscillator 211 within the head unit 212 is connected to a loop 210 and energizes the loop 210 with an electrical signal driven at a frequency. A threshold frequency is stored in a memory at the head unit 212. If the frequency detected moves above the threshold frequency a vehicle is indicated to be in the vicinity of the loop 210.

Temperature sensors (not shown) are present in the head unit 202 to measure the temperature of components that affect the frequency of the loop 210, for instance, the oscillator 211. The temperature is applied to a relationship stored at the memory of the head unit 202 to obtain an adjustment value or action. The adjustment value or action is applied to adjust characteristics of the loop detector circuit, for instance, the detection threshold or oscillator characteristics, in order to adjust for temperature variations in the components that drive and/or sense the loop 210.

Figure 3:
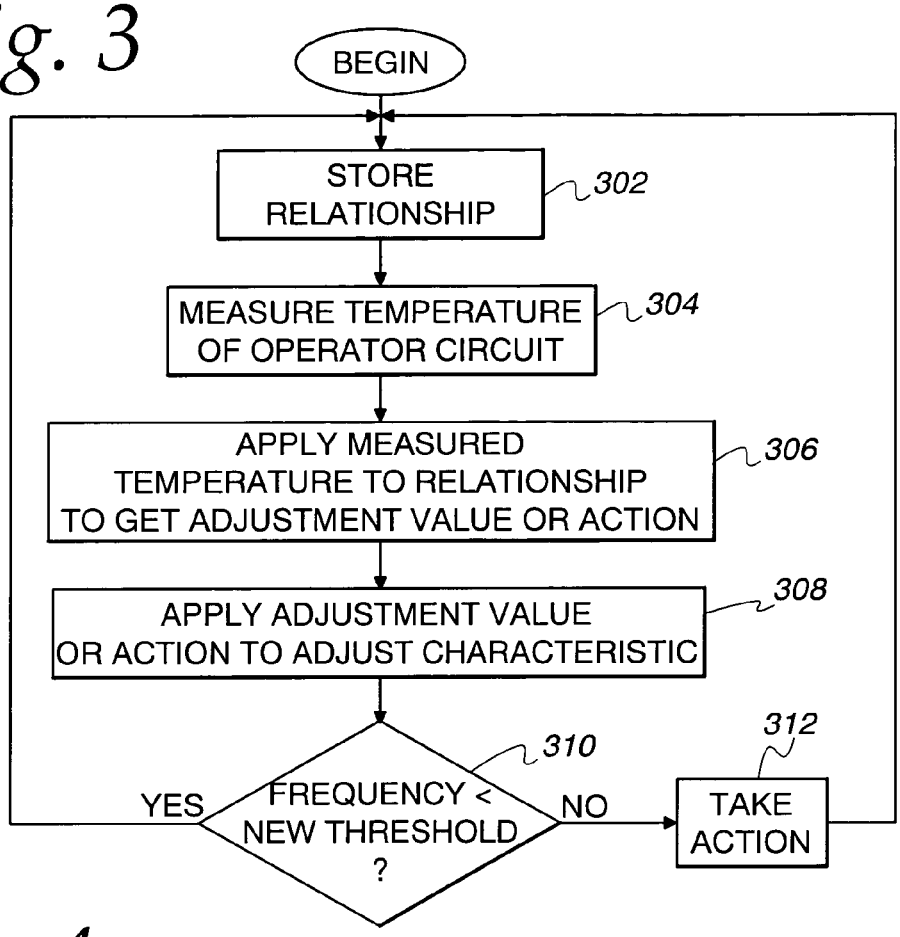
FIG. 3 is a flowchart of an approach for adjusting the detection threshold of a loop detector according to the present invention.

Referring now to FIG. 3, one example of an approach for adjusting the detection threshold using temperature measurements in a moveable barrier system is described. At step 302, the system determines a relationship between a measured temperature of components that affect a characteristic of operation of a loop in a loop detector system and parameter values or actions.

The detection threshold represents a value that is detected above which a vehicle is believed to be in the vicinity of the loop of the loop detector. The detection threshold may be a frequency value, for instance. In another example, the detection threshold may be a current value.

In one example, the relationship defines the correspondence between the measured temperature and the threshold. Specifically, there may be a linear relationship between the measured temperature and the threshold. In another example, an equation may be used to represent the relationship. In still another example, the relationship may be represented in a lookup table.

In yet another example, the relationship defines the correspondence between temperature and parameters that keep the frequency of the oscillator at a fixed value. For instance, for temperatures from 100 to 120 degrees Fahrenheit, the gain of the oscillator may be adjusted to a first value to fix the frequency at 10 Khz. For temperatures from 120 degrees to 140 degrees, the gain of the oscillator may be adjusted to a second value to force the frequency to be 10 Khz.

At step 304, the temperature of the components is measured. In addition, the temperature of anything else, for instance, the ground, that affects the characteristics of operation of the loop are measured. The temperature may be measured by any type of temperature-sensing equipment.

At step 306, the measured temperature is applied to the relationship to obtain an adjustment value or action. For example, the system may perform a table look-up if the relationship is stored in a table in memory. The result of the table look-up is the identification of the adjustment value or action. In another example, if an equation is used, then the measured temperature may be applied to the equation to obtain the adjustment value.

At step 308, the adjustment value or action is applied to the characteristics of the loop detector circuit. For example, if the table gives a threshold value from step 306, this value may be added or subtracted from the threshold value. Alternatively, if the table identifies an action that adjusts the characteristics of the oscillator to maintain a constant frequency, that action is performed at step 308.

At step 310, after the characteristics of the loop detector have been adjusted, it is determined if the frequency measured at the oscillator is less than the threshold. If the answer is affirmative, then control returns to step 304 and execution continues as described above. If the answer at step 310 is negative, then at step 312 an action is taken. The action may include sending a signal to a moveable barrier operator to actuate the moveable barrier. Step 312 may take into account other information in deciding the nature of the action to take. For instance, the operator may require a code or other type of identification parameter to be received before the signal is sent to actuate the moveable barrier.

Figure 4:
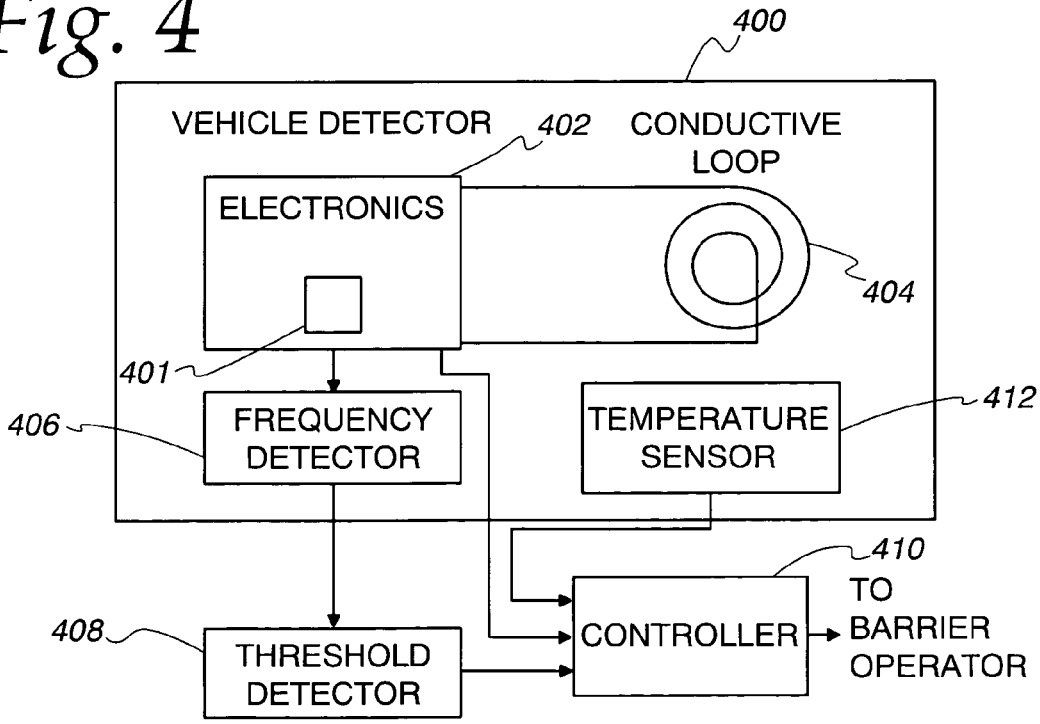
FIG. 4 is a block diagram of a system for compensating for temperature drift in a vehicle detector according to the present invention.

Referring now to FIG. 4, a vehicle detector 400 includes an electronics unit 402, conductive loop 404, and frequency detector 406. The conductive loop 404 is a wire that is driven by the electronics unit 402. The electronics unit 402 includes circuitry such as an oscillator 401 and capacitors to drive the conductive loop 404 at a certain frequency. The frequency detector 406 detects the frequency of operation of the loop 404.

A controller 410 is coupled to the electronics 410 and to a barrier operator. A threshold detector determines when the detected frequency has passed a threshold indicating a vehicle has entered the loop.

Characteristics of the vehicle detector 400 are adjusted based upon a relationship that may be stored in memory. In one example, the oscillator 401 is always desired to be operated at a certain frequency, for instance, 10 Khz. A threshold, for example, 4 percent is selected for use in the threshold detector 408. A temperature sensor 412 measures the temperature of the electronics, the air, or other components of the vehicle detector 400. Based on the temperature, components in the electronics unit 402 are changed to ensure the oscillator 401 is driven at the pre-set frequency. The threshold used by the threshold detector 408 is not changed. When the controller 410 determines the threshold is exceeded, a vehicle is believed to be in the loop 404 and the operator can be actuated by the controller 410.

In another example, the threshold of the threshold detector 408 is adjusted based upon temperature. In this case, the oscillator 401 may drift with temperature, but the threshold detection frequency is adjusted for compensation. When the controller 410 determines the new threshold detection frequency is exceeded, a vehicle is believed to be in the loop 400 and the operator can be actuated by the controller 410.

Thus, a system and method allow the detection threshold of a loop detector system to be adjusted due to thermal drift and other environmental conditions. The approaches described herein avoid missed detection of vehicles at the loop as well as premature closing of barriers that can damage vehicles or other objects in the loop.

While there has been illustrated and described particular embodiments of the present invention, it will be appreciated that numerous changes and modifications will occur to those skilled in the art, and it is intended in the appended claims to cover all those changes and modifications which fall within the true scope of the present invention.

What is claimed is:

1. A method of operating a vehicle detector incorporating a conductive loop and oscillator for detecting vehicles, the method comprising:

operating a vehicle detector according to a plurality of predetermined characteristics;

determining a relationship between the temperature of the vehicle detector and the plurality of predetermined characteristics of the vehicle detector and storing the relationship in a table in memory;

measuring the temperature of the vehicle detector;

driving the conductive loop using the oscillator;

identifying an adjustment action from the table in memory using the measured temperature;

adjusting at least one of the plurality of predetermined characteristics of the vehicle detector via the adjustment action and subsequently comparing a change in frequency of the oscillator to a detection threshold frequency to determine if a vehicle is in the vicinity of the conductive loop.

2. The method of claim 1 wherein storing the relationship comprises storing a relationship between the temperature and an action that maintains the frequency of the oscillator at a predetermined value.

3. The method of claim 1 wherein storing the relationship comprises storing a relationship between the temperature and an adjustment value for adjusting the detection threshold frequency.

4. The method of claim 3 further comprising determining a weighted average related to the detection threshold frequency and wherein adjusting at least one of the plurality of the characteristics comprises adjusting the detection threshold frequency using the weighted average and the adjustment value.

5. In a vehicle detector comprising a conductive loop connected as an electrical component of oscillator circuitry and an oscillation frequency detector, a method comprising:

operating the vehicle detector in accordance with predetermined characteristics;

measuring a temperature of the vehicle detector;

altering the predetermined characteristics of the vehicle detector in response to the measured temperature; and detecting a presence of vehicles in proximity to the conductive loop by detecting changes in a frequency of the oscillation frequency detector in accordance with the altered predetermined characteristics.

6. The method of claim 5 wherein altering the predetermined characteristics comprises altering the frequency of the oscillation frequency detector.

7. The method of claim 5 wherein altering the predetermined characteristics comprises altering a detection threshold.

8. The method of claim 5 wherein altering the predetermined characteristics comprises altering the frequency of the oscillation frequency detector and the detection threshold.

9. The method of claim 5 wherein the vehicle detector is used in conjunction with a gate.

10. A system for adjusting the parameters of a loop detector comprising:

a temperature sensor for sensing a temperature;

a memory having a mapping relationship stored therein; and a controller coupled to the temperature sensor and the memory, and having an output, the controller programmed to determine an action to adjust characteristics of a vehicle detector based upon the temperature and the mapping relationship, and to apply the adjustment action to alter the characteristics of the vehicle detector at an output.

11. The system of claim 10 wherein the controller is programmed to determine a relationship between temperature and an action to adjust the frequency of the oscillator to a predetermined value.

12. The system of claim 10 wherein the controller is programmed to determine a relationship between temperature and an adjustment value for the detection threshold frequency.

13. The system of claim 12 wherein the controller further comprises means for determining a weighted average and means for adjusting the detection threshold based upon the weighted average.

14. The system of claim 10 wherein the output adjusts a frequency of an oscillator.

15. The system of claim 10 wherein the output adjusts a current threshold of the oscillator.

16. A method of operating a movable barrier operator comprising:

measuring a temperature of an operator circuit;

periodically determining a weighted average of a threshold;

determining a relationship between the temperature of the operator circuit and a detection threshold;

applying the relationship to the measured temperature of the operator circuit to create an adjustment value; and using the weighted average as the threshold and subsequently adjusting the detection threshold by the adjustment value.

17. The method of claim 16 wherein adjusting the detection threshold comprises adjusting a frequency of an oscillator at least in part based upon the adjustment value.

18. The method of claim 16 wherein adjusting the detection threshold comprises adjusting a current threshold of an oscillator at least in part based upon the adjustment value.

* * * * *